US009167646B2

(12) United States Patent
Courtel

(10) Patent No.: US 9,167,646 B2
(45) Date of Patent: Oct. 20, 2015

(54) PULSE WIDTH MODULATION FAULT MODE FOR ILLUMINATING DEVICE DRIVERS

(75) Inventor: Karl Jean-Paul Courtel, Reze (FR)

(73) Assignee: Atmel Corporation, San Jose, CA (US)

( * ) Notice: Subject to any disclaimer, the term of this patent is extended or adjusted under 35 U.S.C. 154(b) by 108 days.

(21) Appl. No.: 13/156,310

(22) Filed: Jun. 8, 2011

(65) Prior Publication Data

US 2012/0313545 A1 Dec. 13, 2012

(51) Int. Cl.
*H05B 41/16* (2006.01)
*H05B 33/08* (2006.01)

(52) U.S. Cl.
CPC ..... *H05B 33/0818* (2013.01); *H05B 33/0815* (2013.01); *H05B 33/0824* (2013.01)

(58) Field of Classification Search
USPC ..... 315/209 R, 291, 294, 297
See application file for complete search history.

(56) References Cited

U.S. PATENT DOCUMENTS

| | | | | |
|---|---|---|---|---|
| 7,659,672 | B2 | 2/2010 | Yang | |
| 2007/0159750 | A1* | 7/2007 | Peker et al. | 361/93.1 |
| 2011/0062872 | A1* | 3/2011 | Jin et al. | 315/122 |

* cited by examiner

*Primary Examiner* — Douglas W Owens
*Assistant Examiner* — Jonathan Cooper
(74) *Attorney, Agent, or Firm* — Fish & Richardson P.C.

(57) ABSTRACT

A PWM architecture of a microcontroller is disclosed that includes a fault module for regulating and detecting faults in current sensing or illuminating devices (e.g., LED strings). The fault module is part of a hardware regulation loop of LED voltage and LED current that allows the CPU to be placed in idle mode ("IDLE") while an LED string is regulated in illumination. The microcontroller includes a PWM generator having a double channels PWM timer with a specific fault mode and an amplified comparator with a voltage reference. The architecture allows tuning of various parameters, including LED peak current, LED voltage supply, LED voltage regulation step and LED dimming value. In IDLE mode, the hardware regulation loop can regulate LED peak current and LED voltage supply without any CPU resource (microcontroller in IDLE mode). The fault module part of the hardware regulation loop can also detect and inform the CPU of: 1) an open LED; 2) a weak battery; and 3) an LED voltage that is under a target value.

20 Claims, 15 Drawing Sheets

PULSE WIDTH MODULATION FAULT MODE FOR ILLUMINATING DEVICE DRIVERS

TECHNICAL FIELD

This disclosure relates generally to electronics, and more particularly to circuitry for driving illuminating devices, such as Light Emitting Diode (LEDs).

BACKGROUND

Illuminating devices, such as LEDs, are used in electronics for signaling in replacement of traditional incandescent illuminating devices. An example application is a microcontroller-based system which manages several LEDs or LED strings of car backlighting. The cost of a microcontroller is directly dependent on the amount of hardware resources needed to regulate the system, especially the analogue resources like analog to digital conversion (ADC) resources, which can consume significant silicon area.

SUMMARY

A PWM architecture embedded in a microcontroller is disclosed that includes a fault mode module for regulating and detecting failures in current sensing or illuminating devices (e.g., LED strings). The fault mode module is part of a hardware regulation loop of LED voltage and LED current that does not need any ADC and allows the CPU of the microcontroller to be placed in idle mode ("IDLE") while an LED string is illuminated. In some implementations, the microcontroller includes a PWM generator having a double channels PWM timer with a specific fault mode and an amplified comparator with a voltage reference. The PWM with its fault mode module allows tuning of various parameters, including LED peak current, LED voltage supply, LED voltage regulation step and LED dimming value. The hardware regulation loop can regulate LED peak current and LED voltage supply without any CPU source (microcontroller in IDLE mode). The fault mode module part of the hardware regulation loop can also detect and inform the CPU of: 1) an open LED; 2) a weak battery; and 3) an LED voltage that is under a target value. Upon failure detection, the CPU can be awakened using an interrupt generated by the fault mode module.

Particular implementations of the PWM architecture provide one or more of the following advantages. The PWM architecture avoids the use of a voltage supply feedback measurement and its associated ADC resources, and allows the CPU of the microcontroller to be placed in IDLE mode while an LED string is illuminated.

The details of one or more disclosed implementations are set forth in the accompanying drawings and the description below. Other features, aspects, and advantages will become apparent from the description, the drawings and the claims.

DETAILED DESCRIPTION

LED Driver Overview

Figure 1:
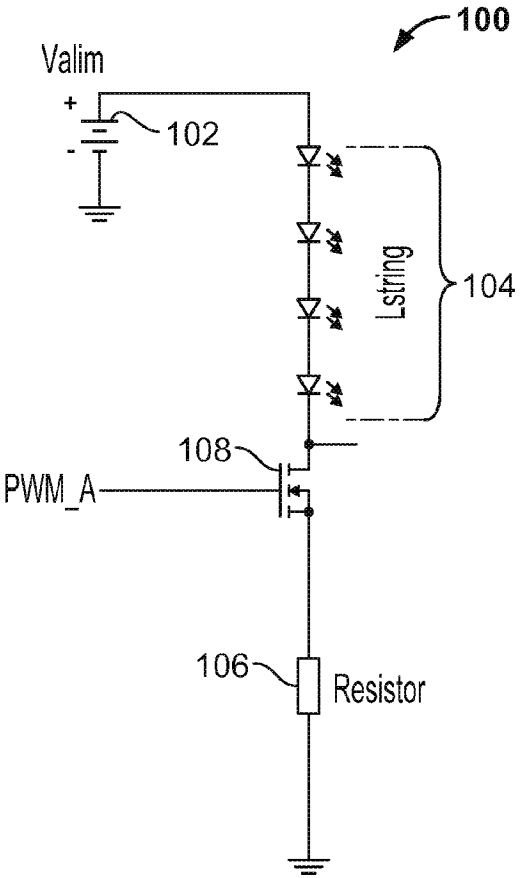
FIG. 1 is a schematic diagram of an example LED control circuit including a current limiting resistor.

FIG. 1 is a schematic diagram of an example LED control circuit 100. LED supply voltage 102 (Valim) is applied to LED string 104 (Lstring) coupled in series with current limiting resistor 106 (e.g., ~300 ohms). The dimming adjustment is done through Field Effect Transistor (FET) 108 driven by Pulse Width Modulation (PWM) signal A (PWM_A). The duty cycle of the PWM_A defines the dimming of LED string 104. Control circuit 100 is suboptimal because of the power dissipated by current limiting resistor 106.

Figure 2:
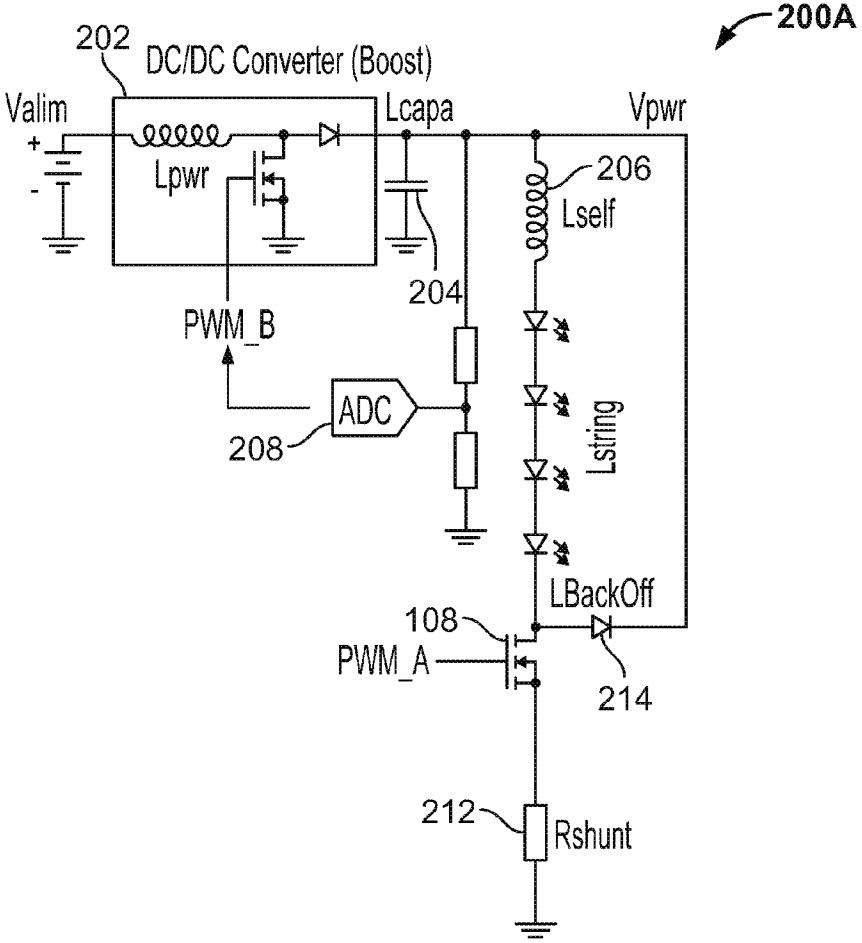
FIG. 2 is a schematic diagram of an example LED control circuit that reduces power consumption by eliminating the current limiting resistor shown in FIG. 1.

FIG. 2 is a schematic diagram of an example LED control circuit 200A that reduces power consumption by eliminating current limiting resistor 106. Control circuit 200 augments control circuit 100 with DC/DC converter 202 (boost-type), capacitor 204 (Lcapa), inductor 206 (Lself), analog-to-digital converter (ADC) 208, shunt resistor 212 (Rshunt) and back-off diode 214 (LBackOff). To reduce power dissipation, circuit 200 does not include current limiting resistor 106. Instead, the operation of circuit 200 is based on a controlled current peak, which allows the current limiting resistor 106 to be replaced by shunt resistor 212 (e.g., <0.1 ohm).

Figure 3A:
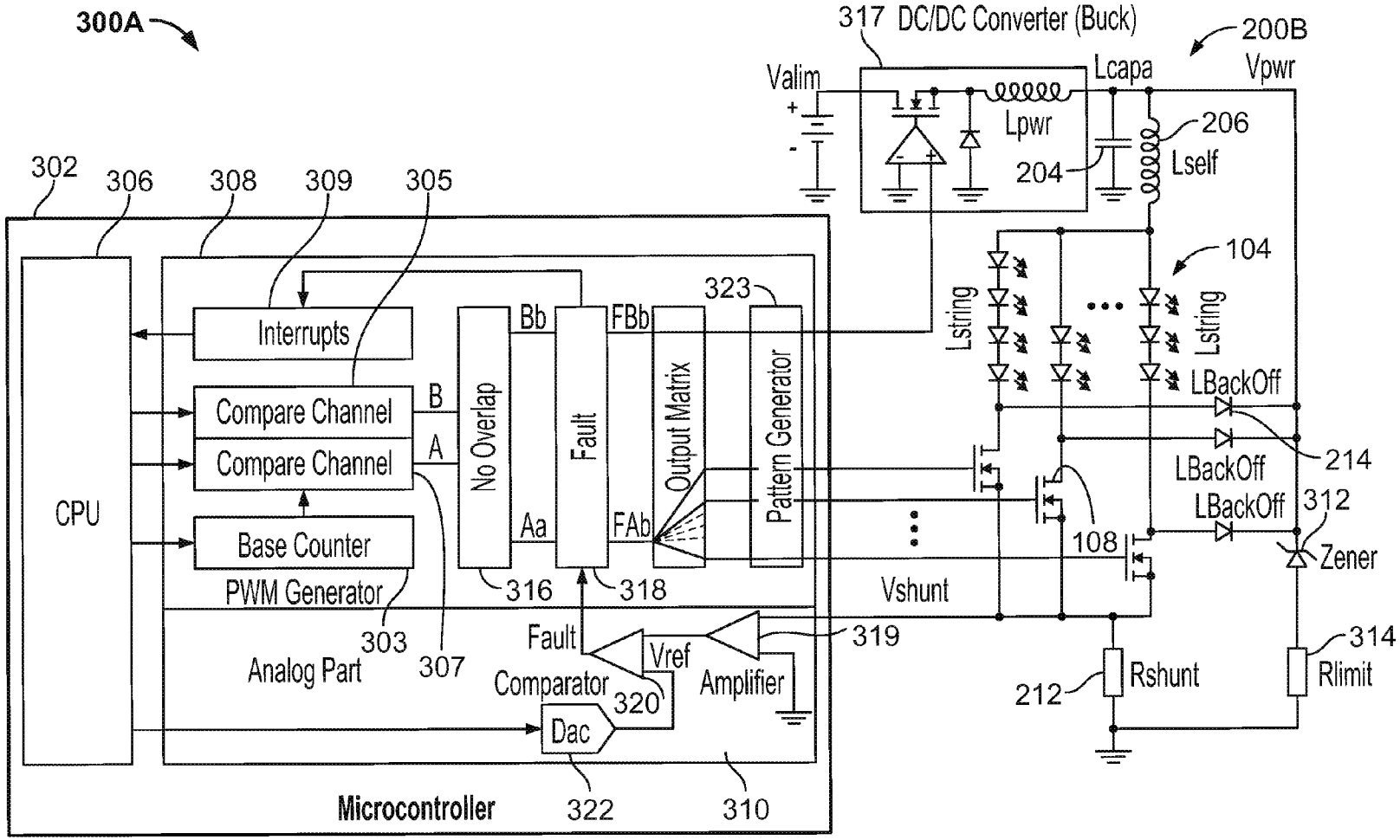
FIG. 3A is an example control system for controlling multiple illuminating devices.

Circuit 200 applies to LED string 104 a voltage adapted to the sum (plus a few millivolts) of all forward LED voltages of LED string 104, and controls the peak and average current flowing into LED string 104. The illumination of each LED in LED string 104 is directly dependent on the average current flowing into the LED. The power supply of LED string 104 (Vpwr) can be generated through DC/DC converter 202, which can be a Buck or Boost DC/DC converter. LED string 104 can have different numbers of LEDs (or LEDs with different characteristics), as shown in FIG. 3A. The output of DC/DC converter 202 can be adapted to the characteristics of LED string 104.

Referring to FIG. 2 and FIG. 3A, control circuit 200 can drive one LED string 104 at a time. Illumination of several LED strings at the same time can be implemented by multiplexing through a pattern generator 323. Pattern generator 323 (FIG. 3A) can selectively clamp output PWM_A signals to block associated FET transistors (e.g., FET 108). For example, multiplexing can include dividing each time slot of 10 milliseconds (to get a minimum frequency of 100 Hertz) by the number of LED strings to manage. If there are five LED strings, there are 2 ms active periods per LED string.

DC/DC converter 202 can be controlled through the duty cycle of PWM_B. The duty cycle depends on Vpwr, which is measured by ADC 208. The duty cycle of PWM_B can be shortened or lengthened depending on the measured Vpwr.

The current rising slope is limited by inductor 206, which makes the current grow progressively into LED string 104. The current flowing into LED string 104 is controlled via the PWM_A pulse having a width that is wider than the time needed to get LED string 104 to reach its peak current value. This enables the base terminal of FET 108 and, by comparator 320, disables the PWM_A pulse when the current into LED string 104 reaches its peak current value. LED string 104 peak current is checked by comparator 320 through shunt resistor 212. When the comparison is reached, the actual current is equal to the targeted LED peak current. The desired average LED current on which illumination of LED string 104 depends can be modified by adapting the PWM_A frequency.

Example LED Control System

Figure 3B:
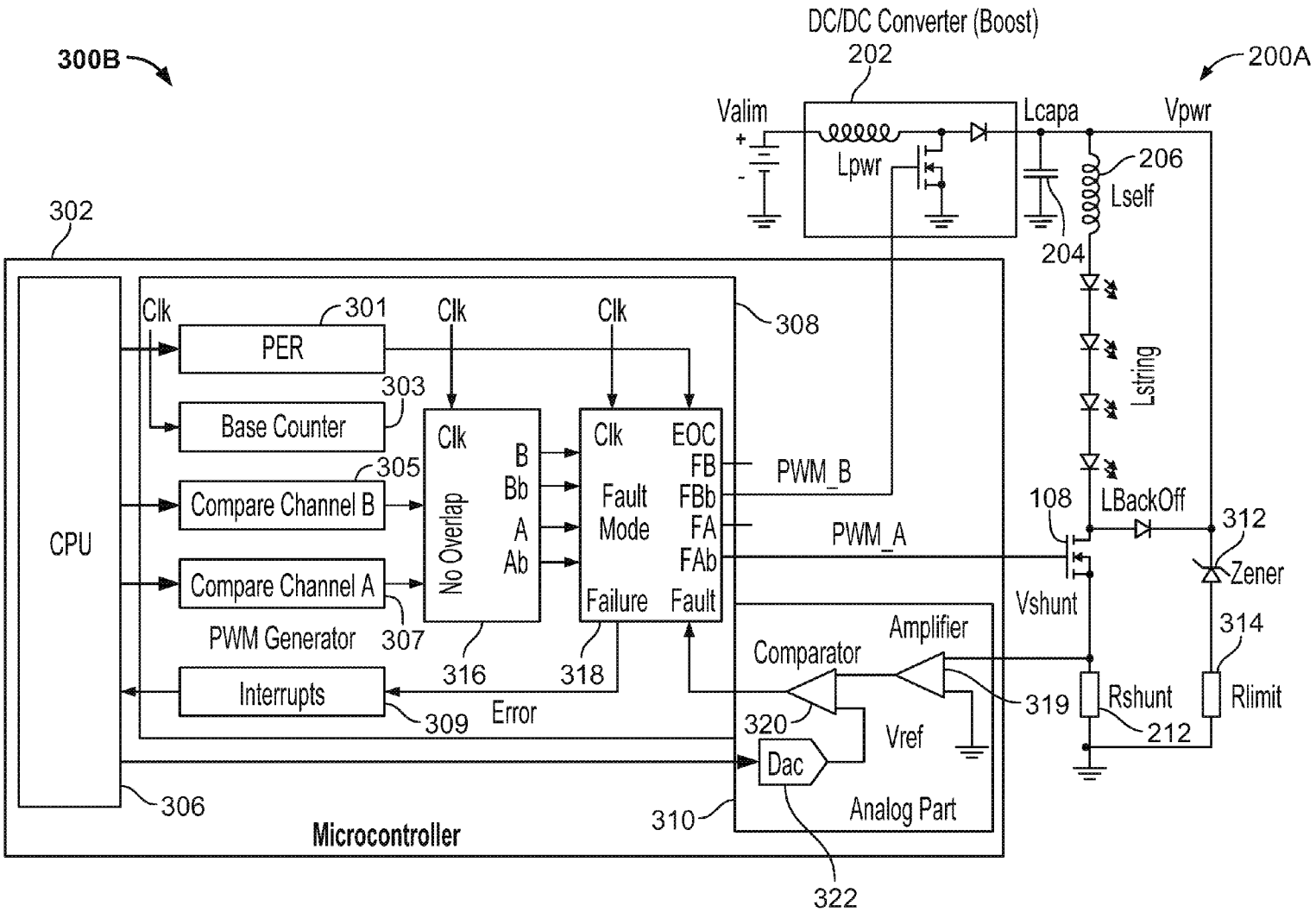
FIG. 3B is an example control system for controlling one string of illuminating devices.

FIG. 3A is an example control system 300A for controlling multiple illuminating devices, such as LEDs or LED strings. FIG. 3B is an example control system 300B for controlling one LED string. In some implementations, microcontroller 302 can include control unit 306 (e.g., central processing unit or CPU), PWM generator 308 and analog part 310. In system 300B, control circuit 304 is similar to control circuit 200A shown in FIG. 2, but also includes Zener diode 312 and limiting resistor 314 to protect LED string 104 from failures that can lead to an overvoltage. Control circuit 200B shown in FIG. 3A includes a buck-type DC/DC converter 317. The following example control is directed to control system 300B for controlling a single LED string 104. Control system 300B, however, can control any current sensing illuminating device that needs to be regulated and that could benefit from fault detection.

In some implementations, PWM generator 308 includes period counter (PER) 301 on which compare channel registers 305, 307 are compared, base counter register 303 for storing a reloadable period count for PER 301, compare channel registers 305, 307 for generating PWM waveforms, interrupts register 309 for storing failure interrupts generated by fault mode module 318, no overlap module 316 and fault mode module 318. Fault mode module 318 replaces the conventional Vpwr feedback measurement circuit and its associated ADC resources, shown in FIG. 2.

In some implementations, analog part 310 includes optional amplifier 319, comparator 320 and a digital-to-analog converter (DAC) 322. A shunt voltage (Vshunt) across shunt resistor 212 is optionally amplified by amplifier 319 and input into comparator 320 to be compared with a fixed or adjustable reference voltage (Vref) selectable by control unit 306. The current LED string 104 is controlled by FET 108, which is driven by PWM_A (also referred to as FAb pulse). LED string 104 current rising slope is limited by inductor 206 and the running LED current value is accessible via Vshunt.

Signal Ab output by no overlap module 316 has an "on time" value that is set by control unit 306 to a predefined time needed for LED string 104 current to reach its peak value at an optimal Vpwr level. If the LED current peak value is reached during Ab "on time," comparator 320 in analog part 310 emits a fault signal to fault mode module 318, which adjusts FAb to place FET 108 into an "off state." When FET 108 is in an "off state," the current into inductor 206 is diverted through LED string 104 and back-off diode 214.

Microcontroller 302 can be placed in IDLE mode while LED string 104 is illuminated because analog part 310 and fault mode module 318 regulates the voltage and current of LED string 104 without using any ADC or CPU calculation resources of microcontroller 302.

Example Timing Diagrams For LED Control System

Figure 4:
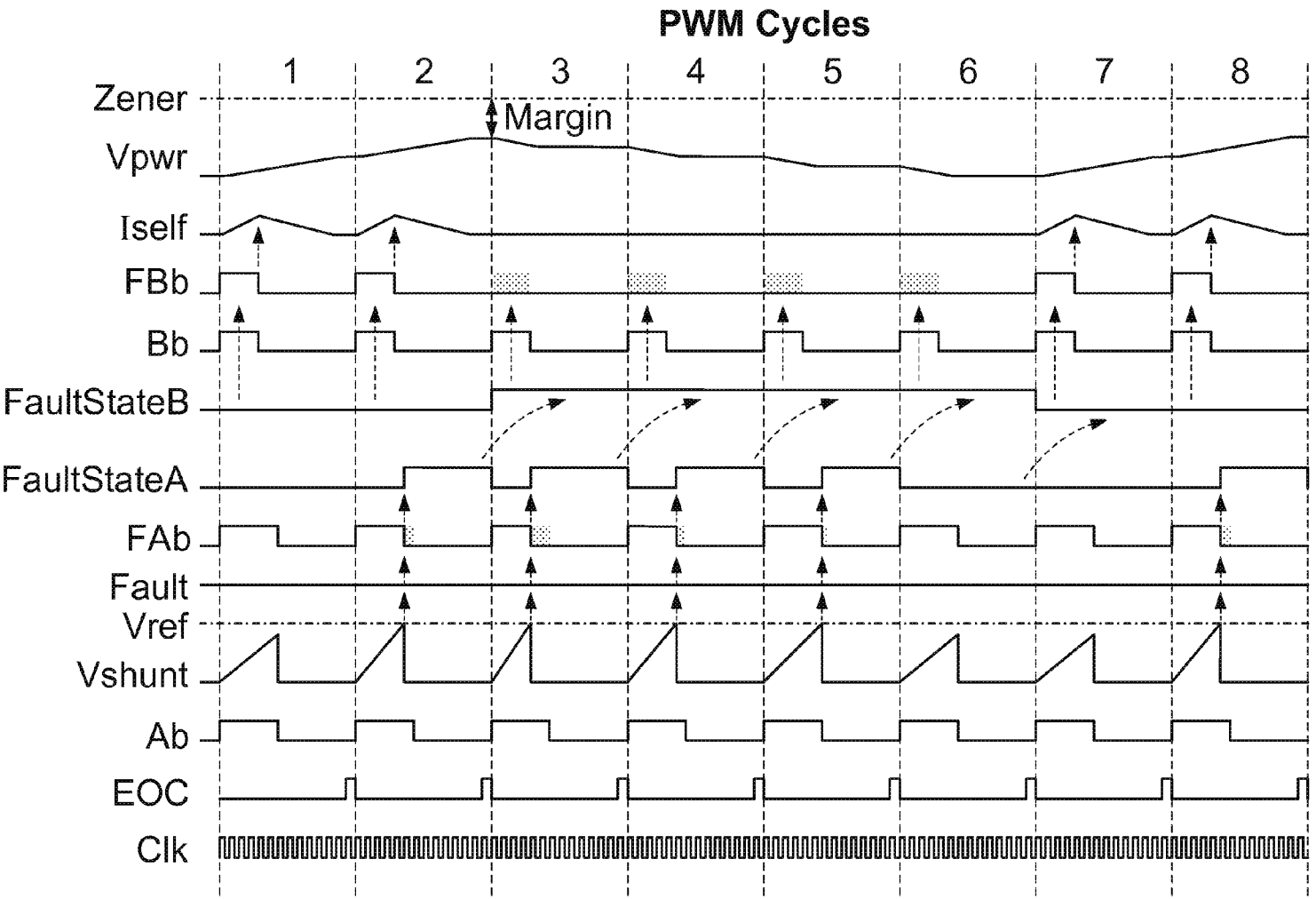
FIG. 4 is a timing diagram illustrating voltage and current regulation of an LED string by the LED control system of FIG. 3B.

FIG. 4 is a timing diagram illustrating voltage and current regulation of LED string 104 by LED control system 300 of FIG. 3B. At each cycle (8 cycles are shown), during Ab "on time" phase, if no fault occurs, then Vpwr is lower than the ideal value, so the next FBb pulse will command DC/DC converter 202 to add a quantum of energy to capacitor 204. This quantum of energy must be higher than the energy needed by LED string 104 at each PWM cycle. If a fault occurs, then Vpwr voltage will be higher than the ideal value, so the next FBb pulse will be clamped to its inactive value and DC/DC converter 202 will not add any quantum of energy to capacitor 204. As a result, the shrink of the width of FAb pulse on fault detection achieves the current regulation of LED string 104. In addition, the enable of FBb pulse, which depends on a fault detection during the previous FAb pulse, regulates the voltage of LED string 104.

If an LED in LED string 104 fails, an open circuit will result suppressing any current through shunt resistor 212. In this case, system 300 thinks that as there is no fault and Vpwr is lower than its optimal value. In this state, DC/DC converter 202 will continue to add quantums of energy onto capacitor 204, making Vpwr growing until Zener diode 312 reaches its breakdown voltage. If the quantum of energy injected by DC/DC converter 202 is more than two times higher than the energy needed by LED string 104 at each cycle, such a situation can be detected by monitoring for the presence of a fault during the subsequent FAb pulse to an unmasked FBb pulse.

FIG. 4 is a timing diagram illustrating Vpwr regulation. Referring to the example waveform of FIG. 4, during cycle 1, Vshunt does not reach Vref. A low FaultStateA (recording Fault occurrence during PWM cycle) causes (through its one PWM cycle delayed copy FaultStateB) Bb and FBb to go high on the next cycle, resulting in DC/DC converter 202 adding quantums of energy to capacitor 204 during cycle 2. The quantum of energy added to capacitor 204 during cycles 1 and 2 causes Vpwr to rise. When Vpwr rises, Vshunt rises to Vref. When Vshunt reaches Vref in cycle 2, the width of FAb shrinks and FaultStateA goes high, which in turn causes FaultStateB to go high. When FaultStateB goes high, FBb becomes inactive (no pulses) so that energy quantums are no longer added to capacitor 204. FBb remains inactive through cycles 4-6. The width of FAb continues to shrink in cycle 3 and then increases for cycles 4 and 5 until full width is regained in cycle 6. In cycle 6, Vshunt does not reach Vref and FaultStateA goes low. In cycle 7, FaultStateB goes low, Bb and FBb become active, causing DC/DC converter 102 to add energy quantums to capacitor 204.

Figure 5:
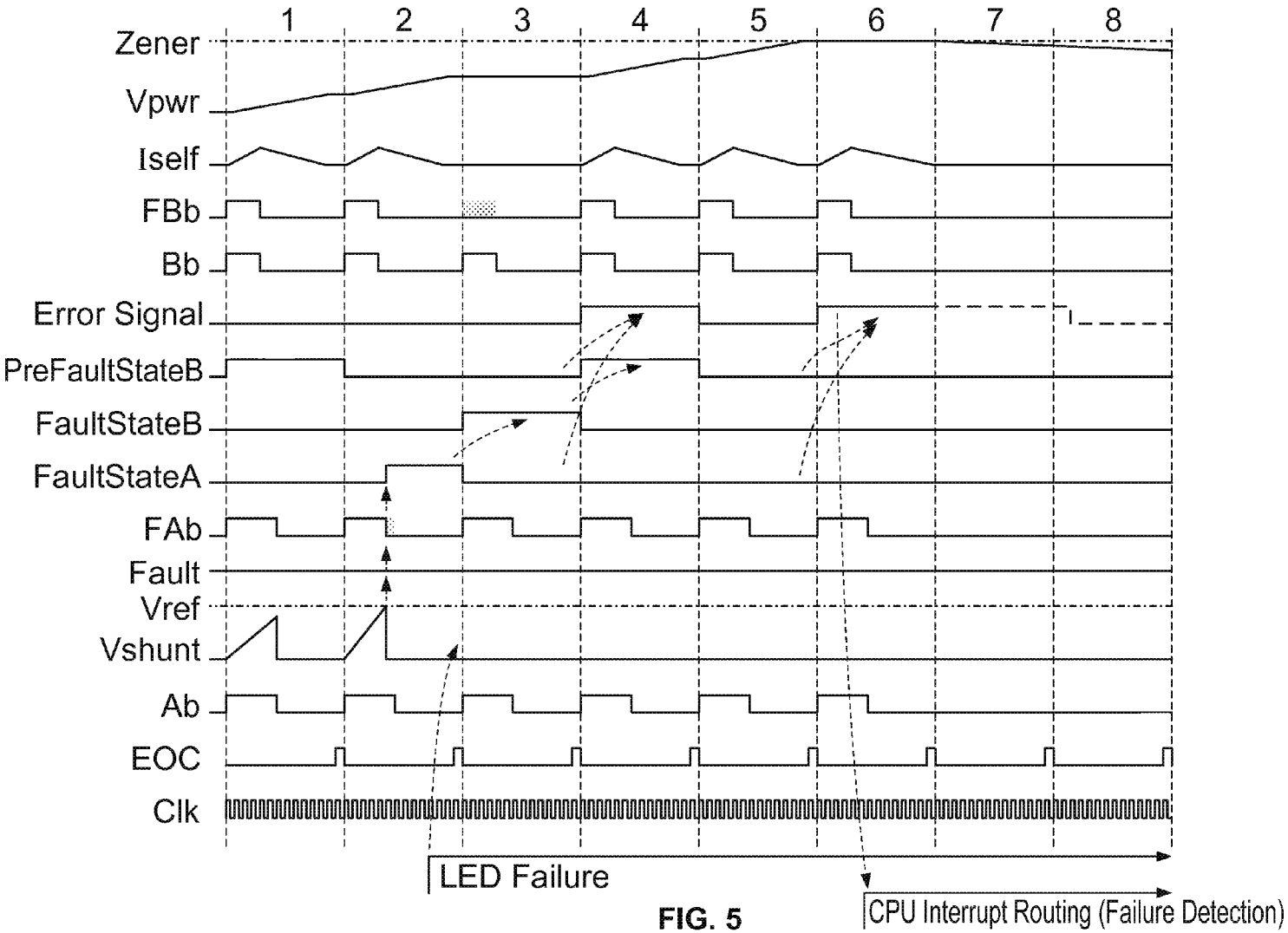
FIG. 5 is a timing diagram illustrating LED failure and fault detection.

FIG. 5 is a timing diagram illustrating LED failure and failure detection. Just after FBb is provided to DC/DC converter 202, the voltage on capacitor 204 should be sufficient to make the current in LED string 104 reach its maximum value inside the subsequent FAb pulse. If this is not the case, then an error has occurred which can be reported to CPU 306. The error can occur from an open LED string 104. In this case, stretching the FBb pulse will not make the error disappear. The error also can occur from a weakened battery. In this case, stretching the FBb pulse will make the error disappear. Finally, the error can occur because the LED voltage has not reached its target value (e.g., start of the system or switch of LED string). In this case, the error will disappear after a few microseconds.

After an FBb pulse with no fault occurring during the subsequent FAb pulse (when FaultStateA and PreFaultStateB are both low at the end of the PWM cycle), fault mode module 318 can emit to CPU 306 a signal (interruption) to alert to the CPU which can activate a spare LED string to replace the failing LED string or stop the system. A shorted LED can also be detected at the time the short failure occurs by detecting an abnormal series of adjacent cycles, where the FBb pulse is disabled (FaultStateB at active level for abnormal consecutive cycles), or during startup time, when the starting error disappears after an abnormally short time. Abnormal consecutive cycles where the FBb pulse is disabled can be detected by the overflow of a cycle counter incremented on the EOC signal and reset on the FBb signal.

Referring to the example of FIG. 5, during cycle 2 FBb is high, causing DC/DC converter 202 to add quantums of energy to capacitor 204. At the end of cycle 2, there is an LED failure, causing Vshunt to clamp to zero (e.g., an open circuit). In cycle 3, FaultStateA stays at a low level with a PreFaultStateB high (DC/DC active pulse during previous cycle), causing an error signal to be asserted in cycle 4. The Error signal causes an interrupt to be generated by fault mode module 318 and sent to control unit 306 to indicate the failure.

Fault Mode Description

In some implementations, control unit 306 can use four independent parameters to control LED string 104 and detect faults. Control unit 306 uses a PWM period value for controlling LED dimming, an output A pulse width for controlling LED voltage supply (Vpwr), an output B pulse width value for controlling the level of quantum energy injected by DC/DC converter 202 and a DAC value (Vref) for controlling the LED peak current. In some implementations, the output pulse A and output pulse B can be provided by timer module 316 of PWM generator 308 shown in FIG. 3B.

In some implementations, three example fault cases can be managed by system 300. The faults cases are summarized as follows.

Case 1: A fault occurs during pulse A

1. Next pulse B will be disabled.
2. Pulse A is shrunk, clamped to its inactive value from the fault to the end of the current PWM cycle.

Case 2/3: No fault during pulse A:

1. The next pulse B will be enabled.
2. Pulse A is not altered.

Case 3: the previous Pulse B was enabled:

An error signal (interrupt setting) is generated on the next PWM cycle.

The logic of fault mode module 318 can be implemented in four different PWM pulse configurations as summarized in Table I below.

TABLE I

Example PWM Pulse Configurations

| Case | PWM Configurations | Pulse A | Pulse B |
|---|---|---|---|
| A | Overlapped pulses at beginning of PWM cycle | Ab | Bb |
| B | Overlapped pulses at end of PWM cycle | A | B |

TABLE I-continued

Example PWM Pulse Configurations

| Case | PWM Configurations | Pulse A | Pulse B |
|---|---|---|---|
| C | No overlapped pulses with A before B | A | Bb |
| D | No overlapped pulses with B before A | Ab | B |

FIGS. 6-15 are block diagrams of examples of logic for fault mode module 318 and corresponding waveforms for implementing the PWM pulse configurations in Table I. Referring to the output of no overlap module 316, pulse A is active from the comparison time to the end of the PWM cycle, pulse Ab is active from the start of the PWM cycle to the comparison time, pulse B is a pulse active from the comparison time to the end of the PWM cycle, pulse Bb is a pulse active from the start of the PWM cycle to the comparison time, MOC is one clock pulse generated during the dead time between pulses A and B, and EOC is one clock pulse generated at the end of the PWM cycle.

Figure 6:
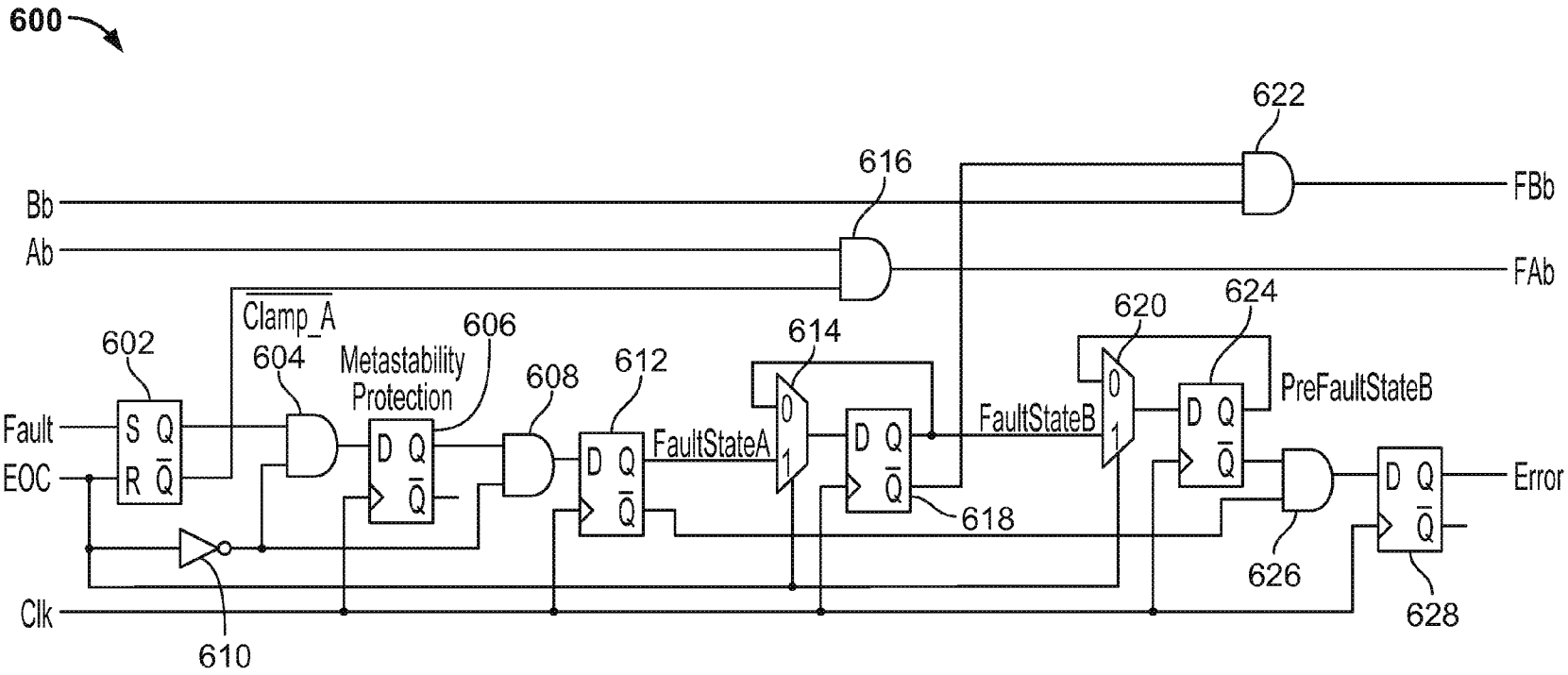
FIG. 6 is example logic for Case A PWM pulse configuration.

FIG. 6 is example logic 600 for Case A PWM pulse configuration. In some implementations, logic 600 can include SR flip-flop (SFF) 602, inverter 610, D flip-flops (DFFs) 606, 612, 618, 624, 628, "And" gates 604, 608, 616, 622, 626 and multiplexers 614 and 620. Note that DFF 606 is for metastability protection.

Signals Bb, Ab, Fault, EOC and Clk are received as inputs into logic 600. In some implementations, and referring to FIG. 3B, Bb and Ab are provided by no overlap module 316 based on inputs from CPU 306, Fault is provided by output of comparator 320 and EOC is provided by PER counter 301. The outputs of logic 600 are FBb, FAb and Error. FBb (PWM_B) is coupled to DC/DC converter 202 to control the output of DC/DC converter 202, FAb (PWM_A) is coupled to FET 108 to control the state of FET 108 and Error is generated by fault mode module 318 and stored in interrupt register 309 to be processed by CPU 306, as shown in FIG. 3B.

Figure 7:
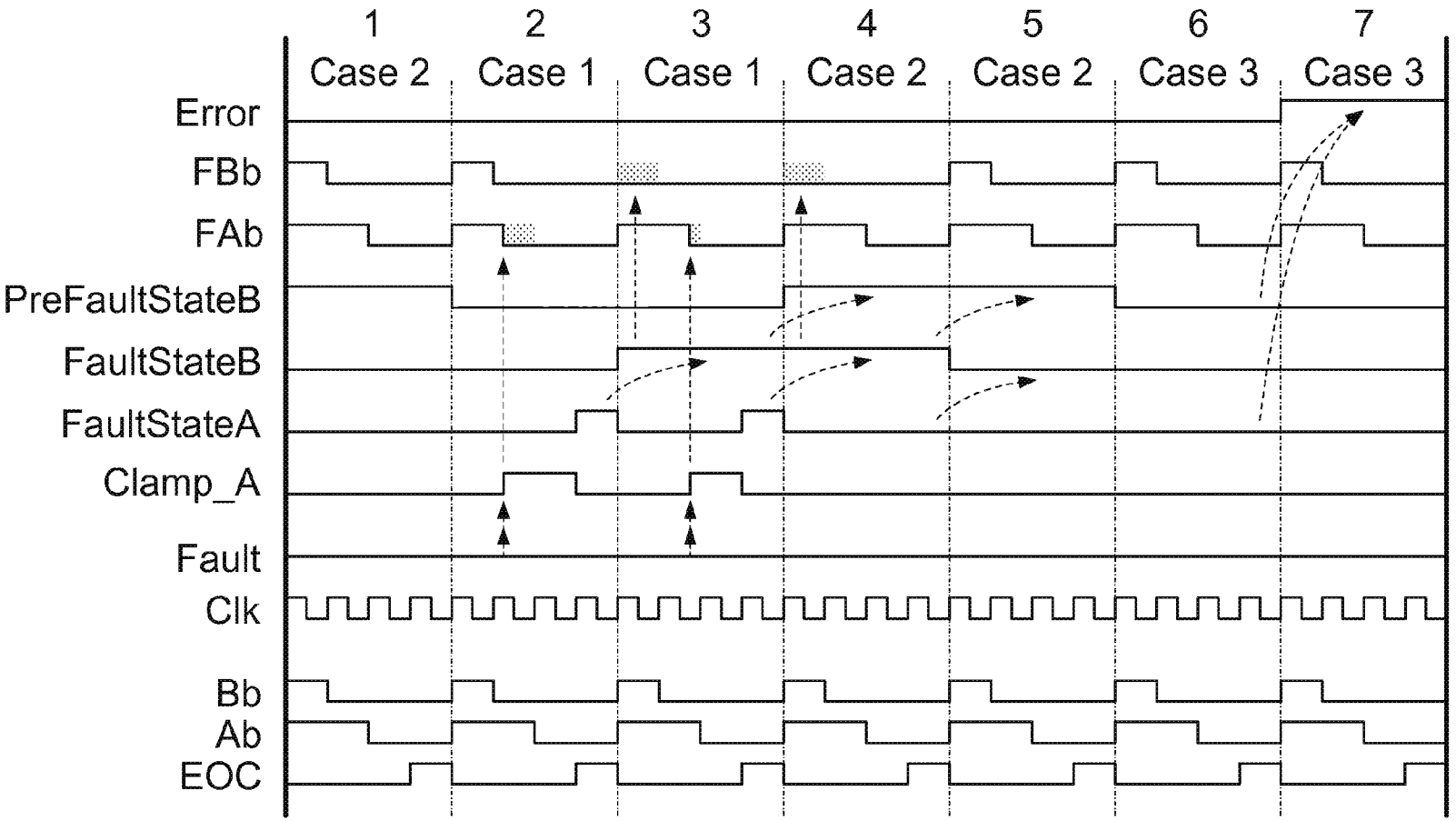
FIG. 7 is the corresponding waveform for Case A PWM pulse configuration.

FIG. 7 is the corresponding example waveform for Case A PWM pulse configuration (7 cycles shown). For each cycle, the fault case is listed. In fault case 1 (a fault occurs during pulse Ab), the next pulse FBb is disabled through a FaultStateB copy of the previous cycle value of the FaultStateA signal, which records the occurrence of a fault during the current cycle.

In fault case 2/3 (no fault occurs during pulse Ab), the next pulse FBb is not disabled. In fault case 3, an error is generated on the next cycle because of the simultaneous low level on either of FaultStateA and PreFaultStateB, which denote the absence of fault after a DC/DC active pulse.

Figure 8:
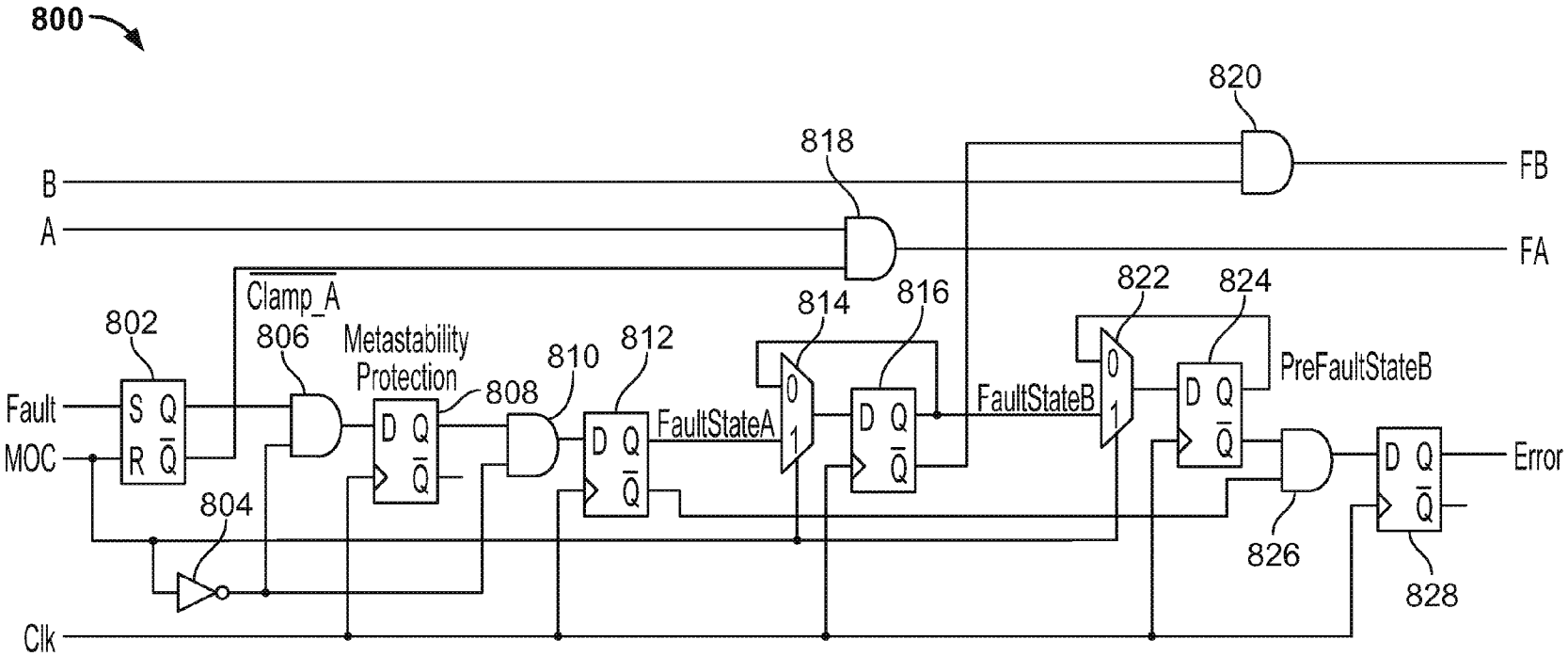
FIG. 8 is example logic for Case B PWM pulse configuration.

FIG. 8 is example logic 800 for Case B PWM pulse configuration. In some implementations, logic 800 can include SFF 802, inverter 804, DFFs 804, 808, 812, 816, 824, 828, "And" gates 806, 810, 818, 820, 826 and multiplexers 814 and 822. Note that DFF 808 is for metastability protection.

Signals A, B, Fault, MOC and Clk are received as inputs into logic 800. In some implementations, and referring to FIGS. 3A, 3B, A and B are provided by no overlap module 316 based on inputs from CPU 306, Fault is provided by output of comparator 320 and MOC is provided by a MOC generator (not shown). The outputs of logic 800 are FB, FA and Error. FB (PWM_B) is coupled to DC/DC converter 202 to control the output of DC/DC converter 202, FA (PWM_A) is coupled to FET 108 to control the state of FET 108 and Error is generated by fault mode module 318 and stored in interrupt register 309 to be processed by CPU 306, as shown in FIGS. 3A, 3B.

Figure 9:
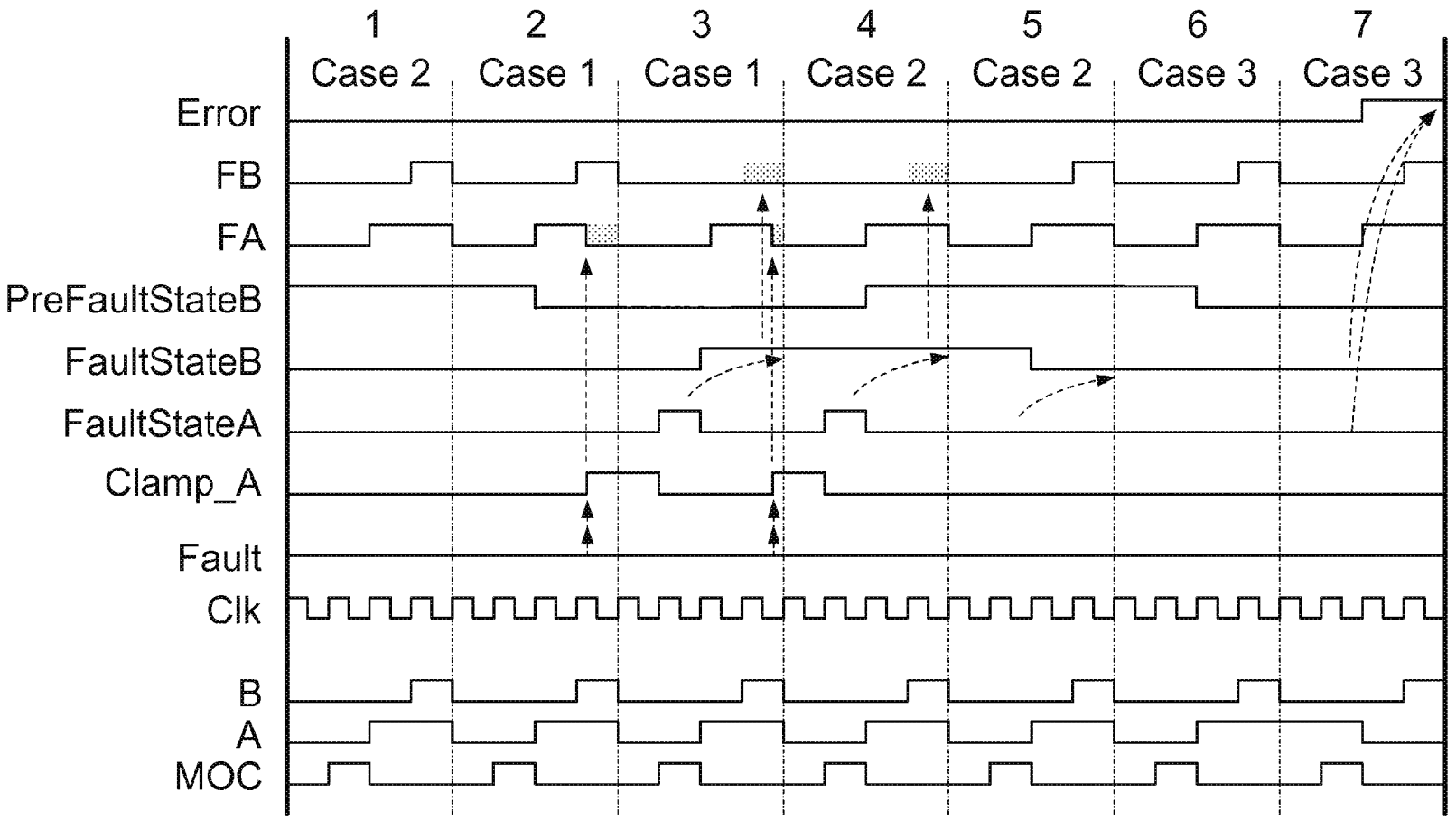
FIG. 9 is the corresponding waveform for Case B PWM pulse configuration.

FIG. 9 is the corresponding example waveform for Case B PWM pulse configuration (7 cycles shown). For each cycle, the fault case is listed. In fault case 1 (a fault occurs during pulse A), the next pulse FB is disabled through FaultStateB copy on the MOC signal of previous value of FaultStateA, which records the occurrence of a fault during the current cycle.

In fault case 2/3 (no fault occurs during pulse A), the next pulse FB is not disabled. In fault case 3, an error is generated on the MOC signal because of the simultaneous low level on either of FaultStateA and PreFaultStateB, which denote the absence of fault after a DC/DC active pulse.

Figure 10:
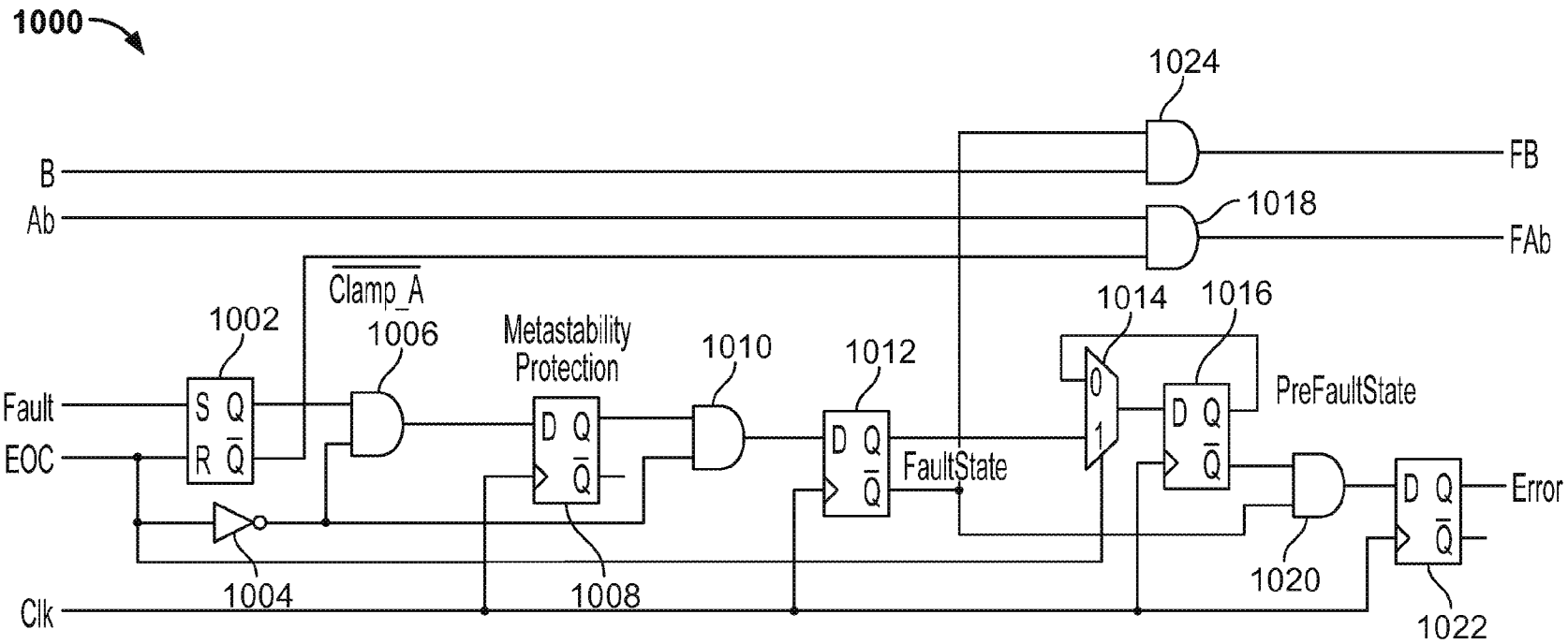
FIG. 10 is example logic for the Case C PWM pulse configuration.

FIG. 10 is example logic 1000 for Case C PWM pulse configuration. In some implementations, logic 1000 can include SFF 1002, inverter 1004, DFFs 1008, 1012, 1016, 1022, "And" gates 1006, 1010, 1024, 1018, 1020 and multiplexer 1014. Signals B, A, Fault, EOC and Clk are provided by timer module 316. Note that DFF 1008 is for metastability protection.

Signals Ab, Bb, Fault, EOC and Clk are received as inputs into logic 1000. In some implementations, and referring to FIGS. 3A, 3B, Ab and Bb are provided by no overlap module 316 based on inputs from CPU 306, Fault is provided by output of comparator 320 and EOC is provided by PER counter 309. The outputs of logic 1000 are FB, FA and Error. FB (PWM_B) is coupled to DC/DC converter 202 to control the output of DC/DC converter 202, FA (PWM_A) is coupled to FET 108 to control the state of FET 108 and Error is generated by fault mode module 318 and stored in interrupt register 309 to be processed by CPU 306, as shown in FIG. 3B.

Figure 11:
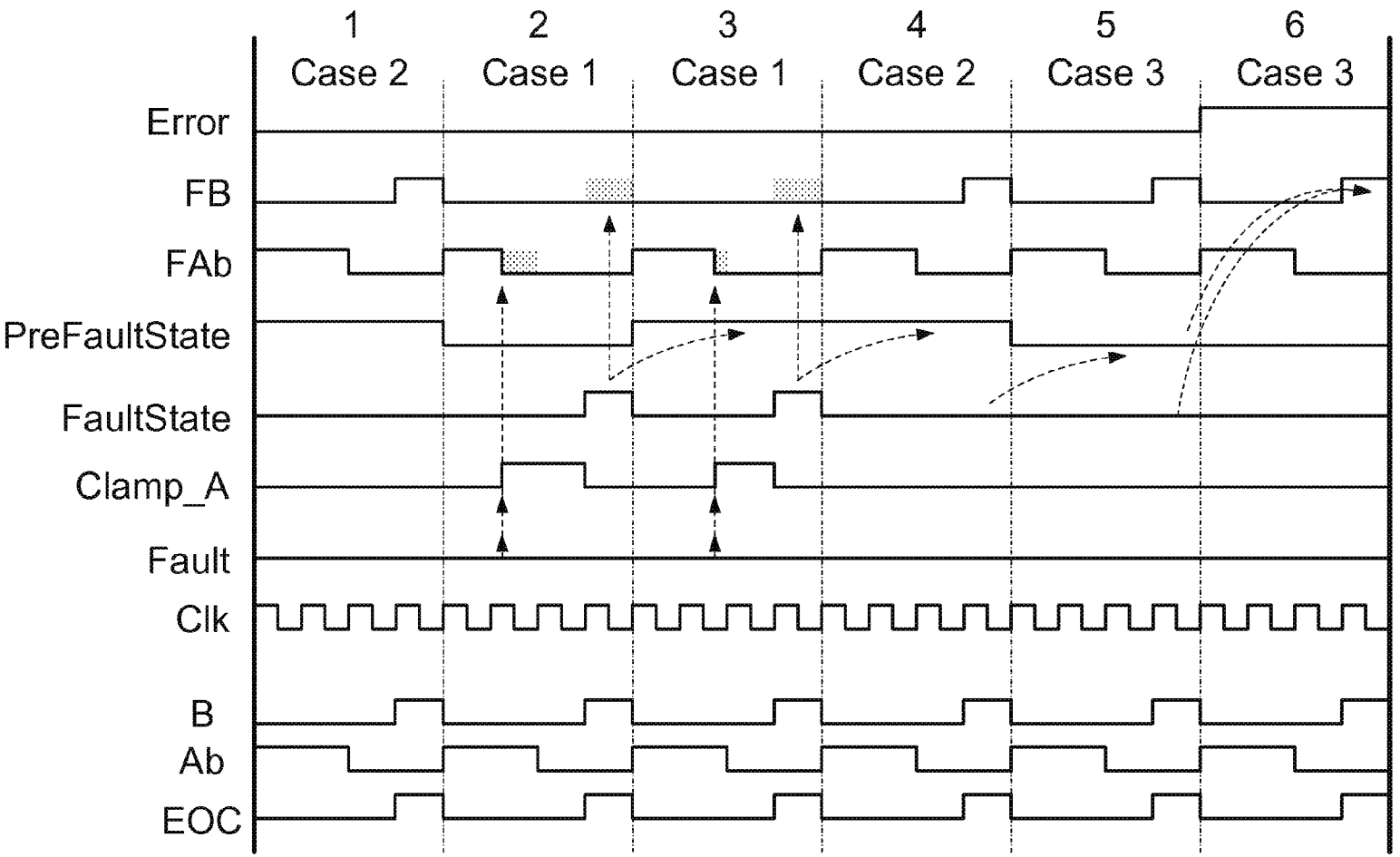
FIG. 11 is the corresponding waveform for the Case C PWM pulse configuration.

FIG. 11 is the corresponding example waveform for Case C PWM pulse configuration (6 cycles shown). For each cycle, the fault case is listed. In fault case 1 (fault occurred during pulse Ab), the next pulse FB is disabled through the FaultState signal which records the occurrence of a fault during the current cycle.

In fault case 2/3 (no fault occurs during pulse Ab), the next pulse FB is not disabled. In fault case 3, an error is generated on the next cycle because of the simultaneous low level on either of FaultState and PreFaultState signals, which denote the absence of fault after a DC/DC active pulse.

Figure 12:
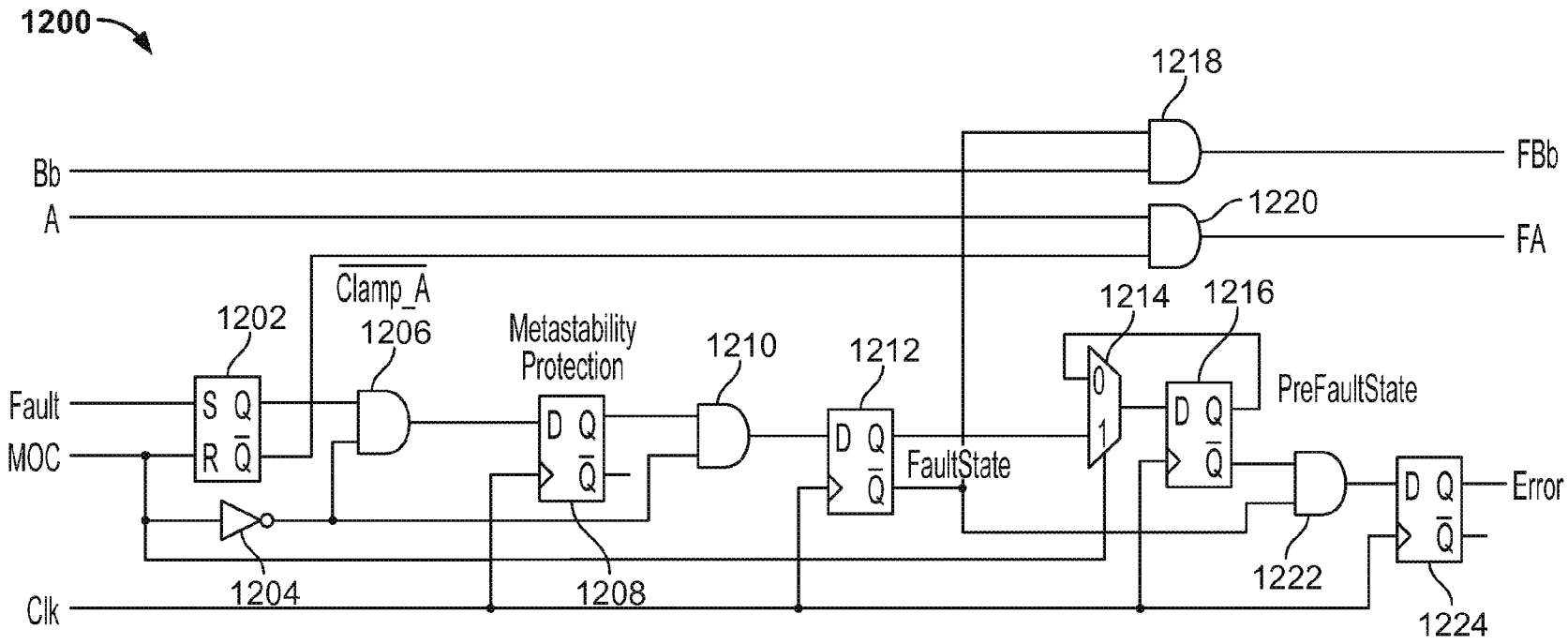
FIG. 12 is example logic for the Case D PWM pulse configuration.

FIG. 12 is example logic 1200 for Case D PWM pulse configuration. In some implementations, logic 1200 can include SFF 1202, DFFs 1208, 1212, 1216, 1224, "And" gates 1206, 1210, 1218, 1220, 1222 and multiplexer 1214. Note that DFF 1208 is for metastability protection.

Signals A, Bb, Fault, MOC and Clk are received as inputs into logic 1200. In some implementations, and referring to FIGS. 3B, A and Bb are provided by no overlap module 316 based on inputs from CPU 306, Fault is provided by output of comparator 320 and MOC is provided by a MOC generator (not shown). The outputs of logic 1200 are FBb, FA and Error. FBb (PWM_B) is coupled to DC/DC converter 202 to control the output of DC/DC converter 202, FA (PWM_A) is coupled to FET 108 to control the state of FET 108 and Error is generated by fault mode module 318 and stored in interrupt register 309 to be processed by control unit 306, as shown in FIGS. 3A, 3B.

Figure 13:
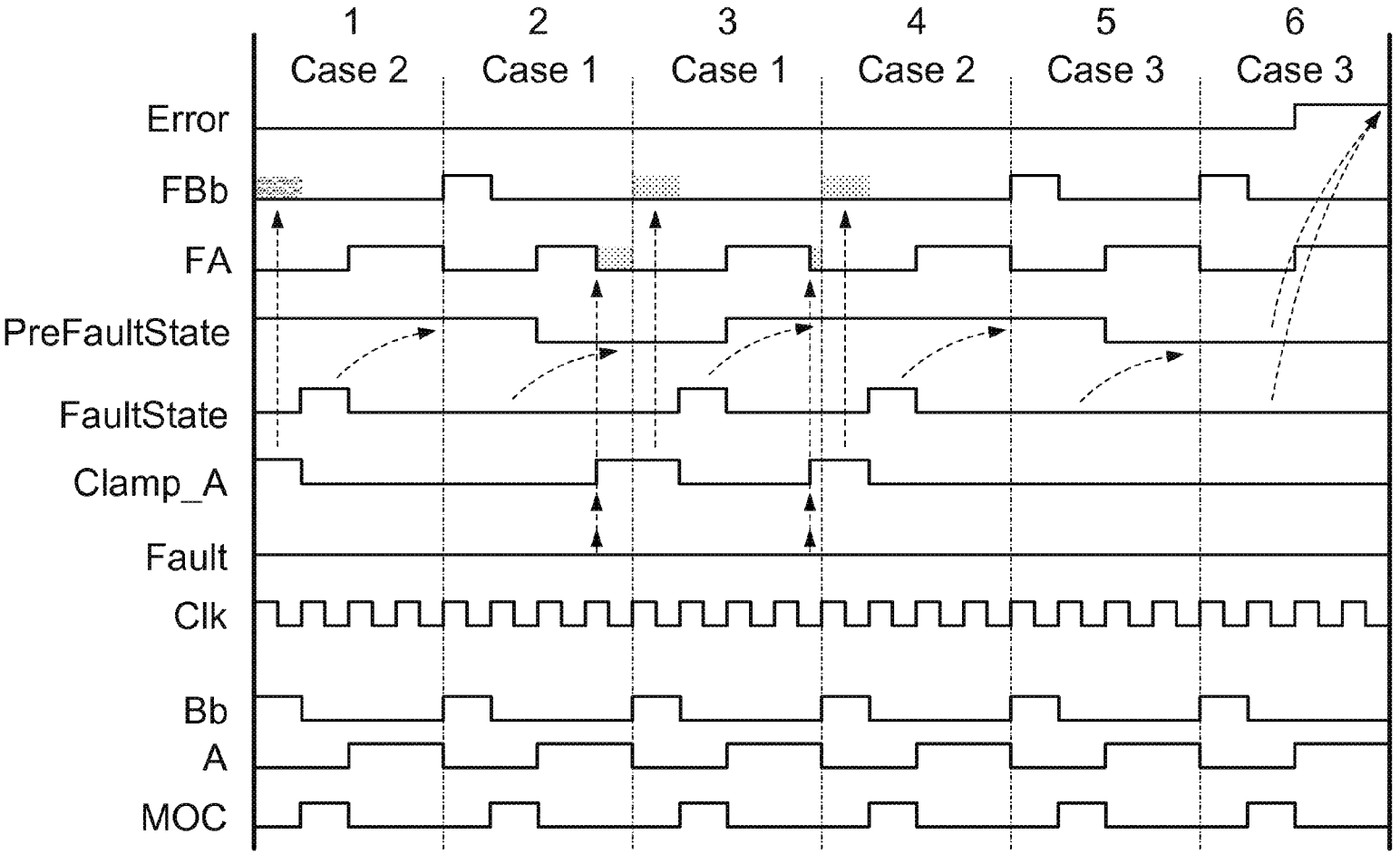
FIG. 13 is the corresponding waveform for the Case D PWM pulse configuration.

FIG. 13 is the corresponding example waveform for Case D PWM pulse configuration (6 cycles shown). For each cycle, the fault case is listed. In fault case 1 (a fault occurs during pulse A), the next pulse FBb is disabled through Clamp_A.

In fault case 2/3 (no fault occurs during pulse A), the next pulse FB is not disabled. In fault case 3, an error is generated on the MOC signal because of the simultaneous low level on either of FaultState and PreFaultState signals, which denote the absence of fault after a DC/DC active pulse.

Figure 14:
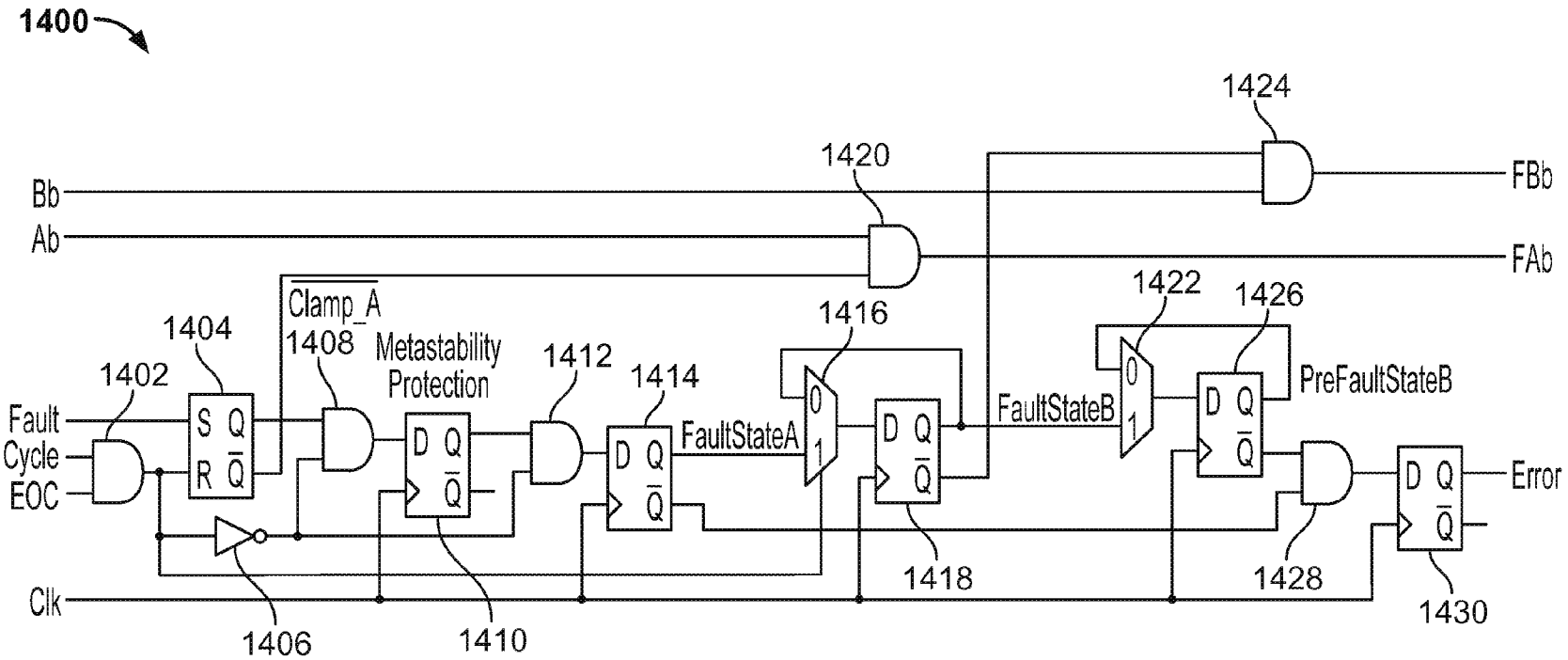
FIG. 14 is example logic for the Case E PWM pulse configuration.

FIG. 14 is example logic 1400 for Case E PWM pulse configuration. In some implementations, logic 1400 can include SFF 1404, DFFs 1410, 1414, 1418, 1426, 1430, "And" gates 1402, 1408, 1412, 1420, 1424, 1428 and multiplexers 1416 and 1422. Note that DFF 1410 is for metastability protection.

Signals Ab, Bb, Fault, Cycle, EOC and Clk are received as inputs into logic 1400. In some implementations, and referring to FIGS. 3A, 3B, Ab and Bb are provided by no overlap module 316 based on inputs from control unit 306, Fault is provided by output of comparator 320 and EOC is provided by PER counter 309. Cycle, which signals odd and even cycles is output of a DFF that toggles at each EOC pulse. The outputs of logic 1000 are FBb, FAb and Error. FBb (PWM_B) is coupled to DC/DC converter 202 to control the output of DC/DC converter 202, FAb (PWM_A) is coupled to FET 108 to control the state of FET 108 and Error is generated by fault mode module 318 and stored in interrupt register 309 to be processed by control unit 306, as shown in FIG. 3B.

Figure 15:
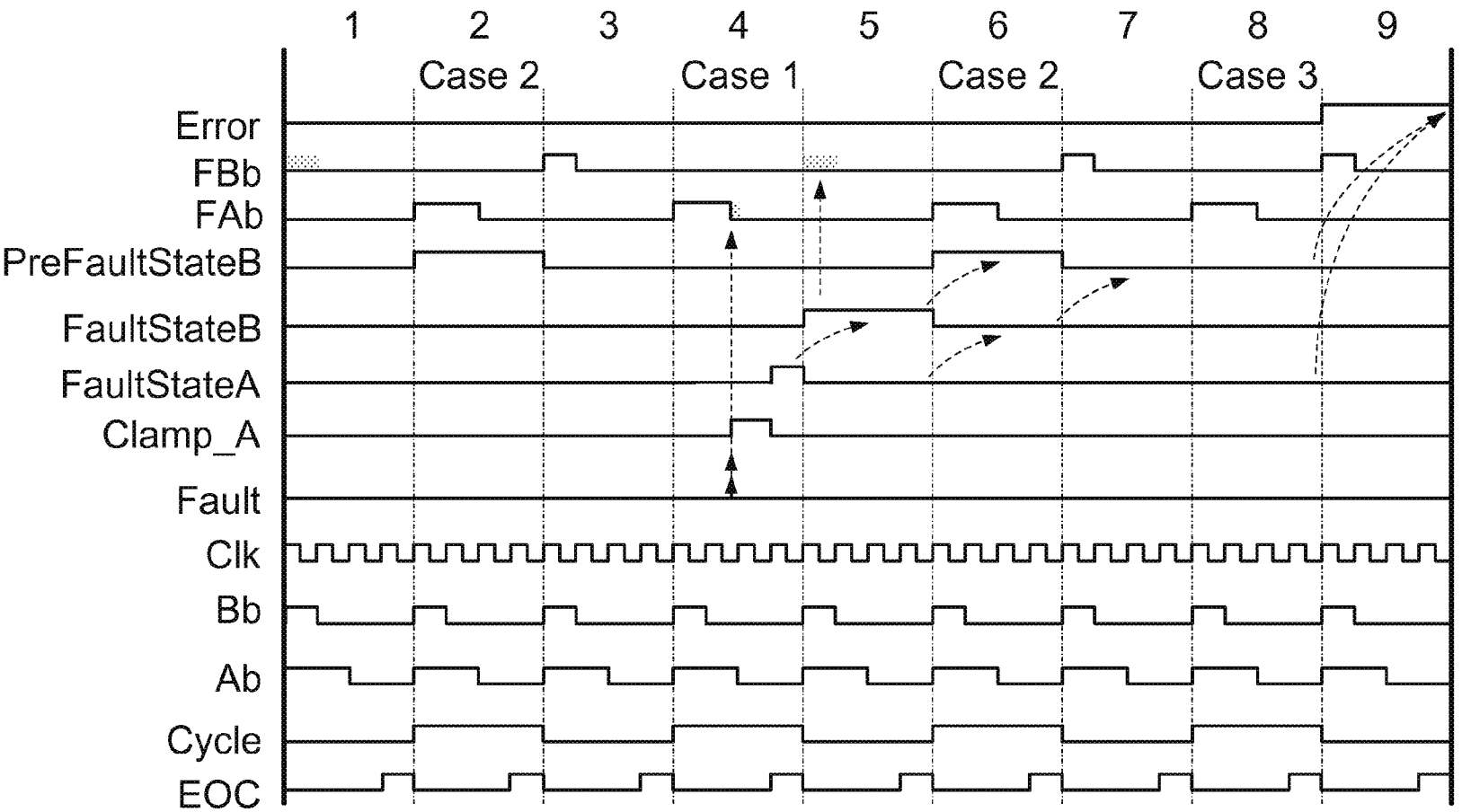
FIG. 15 is the corresponding waveform for the Case E PWM pulse configuration.

FIG. 15 is the corresponding example waveform for Case E PWM pulse configuration (9 cycles shown). Cycles are split in odd and even cycles, Ab pulse active on one type of cycle, Bb on the other cycle. In fault case 1 (a fault occurs during pulse Ab), the next pulse FBb is disabled through FaultStateB copy of a previous cycle value of the FaultStateA signal, which records the occurrence of a fault during the current cycle.

In fault case 2/3 (no fault occurs during pulse Ab), the next pulse FBb is not disabled. In fault case 3, an error is generated on the next cycle because of the simultaneous low level on either of FaultStateA and PreFaultStateB, which denote the absence of fault after a DC/DC active pulse.

While this document contains many specific implementation details, these should not be construed as limitations on the scope what may be claimed (by example case E could be implemented with the same variation than case (A, B), (Ab, Bb), (A, Bb) and (Ab, B)), but rather as descriptions of features that may be specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable sub combination. Moreover, although features may be described above as acting in certain combinations and even initially claimed as such, one or more features from a claimed combination can, in some cases, be excised from the combination, and the claimed combination may be directed to a sub combination or variation of a sub combination.

What is claimed is:

1. A system, comprising:

one or more current sensing devices; and a microcontroller coupled to the one or more current sensing devices and including:

detection circuitry coupled to the one or more current sensing devices;

a central processing unit; and a pulse width modulation generator including a fault mode module coupled to the detection circuitry and the central processing unit, the fault mode module and detection circuitry configured to regulate the one or more current sensing deviceswhile the central processing unit is idle, to detect a fault of the one or more current sensing devices and, upon detecting the fault, to awaken the idle central processing unit to respond to the fault.

2. The system of claim 1, where the one or more current sensing devices include Light Emitting Diodes (LEDs).

3. The system of claim 1, where the fault mode module is configured to regulate voltage across or current through the one or more current sensing devices.

4. The system of claim 1, where the detection circuitry is configured to compare a measurement of one or more regulated parameters with a reference value and to generate a signal based on results of the comparing.

5. The system of claim 4, where the reference value is based on a value defined by the central processing unit.

6. The system of claim 1, further comprising:

circuitry for adding quantums of energy to the one or more current sensing devices, the circuitry configured for receiving output from the microcontroller.

7. The system of claim 6, where the circuitry is a DC/DC converter.

8. The system of claim 1, where the fault mode module is configured to manage at least two pulse width modulation (PWM) outputs for performing the regulating and fault detecting.

9. The system of claim 8, where the fault mode module is configured to force a first PWM output to an inactive value starting from a fault event to an end of a PWM cycle.

10. The system of claim 9, where the fault mode module is configured to cancel a subsequent active pulse on a second PWM output when the fault event occurs during an active period of the first PWM output.

11. The system of claim 10, where the fault mode module is configured to send an error signal when an active pulse on the second PWM output is not followed by an error detection during the subsequent active pulse on the first PWM output.

12. The system of claim 1, where the fault mode module is configured to maintain fault state information, and uses the fault state information in the fault detecting.

13. The system of claim 12, where the fault state information is reinitialized at each PWM cycle.

14. A method comprising:

receiving, by a microcontroller of an illuminating device driver, a signal indicative of a state of one or more regulated parameters of one or more current sensing devices;

regulating at least one of the one or more regulated parameters based on the signal while a central processing unit in the microcontroller is idle;

monitoring, by a fault mode module included in a Pulse Width Modulation (PWM) generator in the microcontroller, for a fault in the one or more current sensing devices based on the signal, where the regulating and monitoring is at least partially implemented by two PWM signals that are generated by the PWM generator based at least partially on the signal; and upon fault detection by the fault mode module, awakening the idle central processing unit to respond to the fault.

15. The method of claim 14, where the fault mode module is configured to force a first PWM signal to an inactive value starting from a fault event to an end of a PWM cycle.

16. The method of claim 15, where the fault mode module is configured to cancel a subsequent active pulse on a second PWM signal when the fault event occurs during an active period of the first PWM signal.

17. The method of claim 16, where the fault mode module is configured to send an error signal when an active pulse on the second PWM signal is not followed by an error detection during the subsequent active pulse on the first PWM signal.

18. The method of claim 14, where the fault mode module is configured to maintain fault state information, and the method further comprises using the fault state information in the fault detecting.

19. The method of claim 18, where the fault state information is reinitialized at each PWM cycle.

20. The method of claim 14, where monitoring for a fault further comprises:

monitoring for at least one of an open current sensing device, a weak battery, or an current sensing device voltage that is under a target value.

* * * * *

UNITED STATES PATENT AND TRADEMARK OFFICE

CERTIFICATE OF CORRECTION

PATENT NO. : 9,167,646 B2
APPLICATION NO. : 13/156310
DATED : October 20, 2015
INVENTOR(S) : Courtel It is certified that error appears in the above-identified patent and that said Letters Patent is hereby corrected as shown below:

In the claims

Column 8, Line 64 Claim 1, delete "deviceswhile" and insert -- devices while --, therefor.

Signed and Sealed this
Twenty-fourth Day of May, 2016

Michelle K. Lee

Michelle K. Lee
*Director of the United States Patent and Trademark Office*